US010284973B2

(12) United States Patent
Fyrlund et al.

(10) Patent No.: US 10,284,973 B2
(45) Date of Patent: May 7, 2019

(54) WEARABLE BAND FOR FACILITATING HEARING

(71) Applicant: Cochlear Limited, Macquarie University, NSW (AU)

(72) Inventors: Henrik Fyrlund, Göteborg (SE); Stefan Magnander, Göteborg (SE); Clas Johansson, Macquarie University (AU)

(73) Assignee: Cochlear Limited, Macquarie University (AU)

( * ) Notice: Subject to any disclaimer, the term of this patent is extended or adjusted under 35 U.S.C. 154(b) by 12 days.

(21) Appl. No.: 15/477,223

(22) Filed: Apr. 3, 2017

(65) Prior Publication Data

US 2018/0288537 A1 Oct. 4, 2018

(51) Int. Cl.
*H04R 25/00* (2006.01)

(52) U.S. Cl.
CPC ..... *H04R 25/606* (2013.01); *H04R 2460/13* (2013.01)

(58) Field of Classification Search
CPC ..... H04R 2460/13; H04R 1/1066; H04R 25/604; H04R 25/606; A61H 2205/02
See application file for complete search history.

(56) References Cited

U.S. PATENT DOCUMENTS 1,531,543 A * 3/1925 Cooper ..... H04L 15/285 178/99.1
2,424,935 A * 7/1947 Kimmel ..... H04R 25/604 381/326
2,891,116 A * 6/1959 Nichols ..... H04R 25/60 381/323
3,134,861 A * 5/1964 Dempsey ..... H04R 1/105 381/151
6,456,721 B1 * 9/2002 Fukuda ..... H04R 1/1066 381/151
6,603,863 B1 * 8/2003 Nagayoshi ..... H04R 1/1066 381/370

(Continued)

FOREIGN PATENT DOCUMENTS

JP 2011-130334 A 6/2011
KR 10-0921524 B1 10/2009
KR 10-2015-0081157 A 7/2015

OTHER PUBLICATIONS

International Search Report and Written Opinion in corresponding International Application No. PCT/IB2018/052087, dated Jul. 18, 2018, 11 pages.

*Primary Examiner* — Brian Ensey
*Assistant Examiner* — Ryan Robinson
(74) *Attorney, Agent, or Firm* — Edell, Shapiro & Finnan, LLC

(57) ABSTRACT

Presented herein are non-surgical or superficial wearable bands for facilitating hearing. In one embodiment, a wearable band in accordance with embodiments presented herein comprises a frame that is shaped to be positioned around a head of a user. The wearable band further comprises at least one drive plate or adapter configured to be disposed around a section of the frame, wherein the adapter is configured to deliver vibration to the head of the user. A vibration isolation member is disposed between the frame and the adapter. The vibration isolation member is configured to isolate the frame from the vibration at the adapter.

20 Claims, 12 Drawing Sheets

(56) References Cited

U.S. PATENT DOCUMENTS

| | | | | |
|---|---|---|---|---|
| 7,076,077 | B2 * | 7/2006 | Atsumi | H04R 1/1066 381/151 |
| 8,094,858 | B2 * | 1/2012 | Thiel | G02C 3/003 381/327 |
| 9,906,853 | B2 * | 2/2018 | Kristo | H04R 1/105 |
| 2004/0096078 | A1 * | 5/2004 | Lin | G02C 11/10 381/333 |
| 2008/0272161 | A1 * | 11/2008 | Roche | A61B 90/35 224/181 |
| 2014/0168349 | A1 * | 6/2014 | Eom | G02B 27/01 348/14.03 |
| 2015/0163579 | A1 | 6/2015 | Kristo et al. | |
| 2016/0088380 | A1 | 3/2016 | Stauber et al. | |
| 2017/0208289 | A1 * | 7/2017 | Feller | H04R 1/105 |
| 2018/0077505 | A1 * | 3/2018 | Bern | H04R 25/606 |

* cited by examiner

WEARABLE BAND FOR FACILITATING HEARING

BACKGROUND

Field of the Invention

The present invention relates generally to hearing prostheses and, more particularly, to a wearable band for facilitating hearing.

Related Art

Hearing loss, which may be due to many different causes, is generally of two types: conductive and sensorineural. Sensorineural hearing loss is due to the absence or destruction of the hair cells in the cochlea that transduce sound signals into nerve impulses. Various hearing prostheses are commercially available to provide individuals suffering from sensorineural hearing loss with the ability to perceive sound. For example, cochlear implants use an electrode array implanted in the cochlea of a recipient to bypass the mechanisms of the ear. More specifically, an electrical stimulus is provided via the electrode array to the auditory nerve, thereby causing a hearing percept.

Conductive hearing loss occurs when the normal mechanical pathways that provide sound to hair cells in the cochlea are impeded, for example, by damage to the ossicular chain or ear canal. Individuals suffering from conductive hearing loss may retain some form of residual hearing because the hair cells in the cochlea may remain undamaged.

Individuals suffering from conductive hearing loss typically receive an acoustic hearing aid. Hearing aids rely on principles of air conduction to transmit acoustic signals to the cochlea. In particular, a hearing aid typically uses an arrangement positioned in the recipient's ear canal or on the outer ear to amplify a sound received by the outer ear of the recipient. This amplified sound reaches the cochlea causing motion of the perilymph and stimulation of the auditory nerve.

In contrast to hearing aids, which rely primarily on the principles of air conduction, certain types of hearing prostheses, commonly referred to as bone conduction devices, convert a received sound into vibrations. The vibrations are transferred through the skull to the cochlea causing generation of nerve impulses, which result in the perception of the received sound. Bone conduction devices are suitable to treat a variety of types of hearing loss and may be suitable for individuals who cannot derive sufficient benefit from acoustic hearing aids, cochlear implants, etc., or for individuals who suffer from stuttering problem

SUMMARY

In one aspect, a wearable band for facilitating hearing is provided. The wearable band comprises: a frame curved to extend partially around an outer surface of a head of a user; first and second flexible contact arms disposed at first and second opposing ends, respectively, of the frame and each extending around a length of the frame; and at least one adapter configured to mechanically attach to at least one of the first or second contact arms and configured to deliver vibration to the head of the user, wherein the adapter is vibrationally isolated from the frame by the at least one of the first or second flexible contact arms.

In another aspect, a wearable band for facilitating hearing is provided. The wearable band comprises: a frame shaped to be positioned around a head of a user; at least one drive plate configured to be disposed around a section of the frame and to deliver vibration to the head of the user; and a vibration isolation member disposed between the frame and the drive plate, wherein the vibration isolation member is configured to isolate the frame from the vibration at the drive plate.

BRIEF DESCRIPTION OF THE DRAWINGS

Embodiments of the present invention are described herein in conjunction with the accompanying drawings, in which.

DETAILED DESCRIPTION

Presented herein are non-surgical or superficial wearable bands, sometimes referred to herein as wearable hearing apparatuses, for facilitating hearing. In one embodiment, a wearable band in accordance with embodiments presented herein comprises a frame that is shaped to be positioned around a head of a user. The wearable band further comprises at least one drive plate or adapter configured to be disposed around a section of the frame, wherein the adapter is configured to deliver vibration to the head of the user. A vibration isolation member is disposed between the frame and the adapter. The vibration isolation member is configured to isolate the frame from the vibration at the adapter.

Wearable bands in accordance with embodiments presented herein may be used with a number of different hearing prostheses. For example, a wearable band in accordance with embodiments presented may be used to couple a bone conduction device, an external component of a cochlear implant, an external component of a middle ear implant, etc. to a head of a user. In addition, wearable bands in accordance with embodiments presented herein may be used to couple luxury hearing prostheses (e.g., devices for which there is no medical necessity) to the head of a user. An example of luxury hearing prostheses are bone conduction devices (e.g., bone conduction headphones) that are used as an alternate method of stimulating the cochlea in a person with normal hearing capabilities. Merely for ease of illustration, wearable bands presented herein will generally be described with reference to use with bone conduction devices for aiding impaired hearing of a user. However, as noted, it is to be appreciated that other wearable bands consistent with the teachings herein and variations thereof may be used with other types of hearing prosthesis components and/or other devices.

Figure 1:
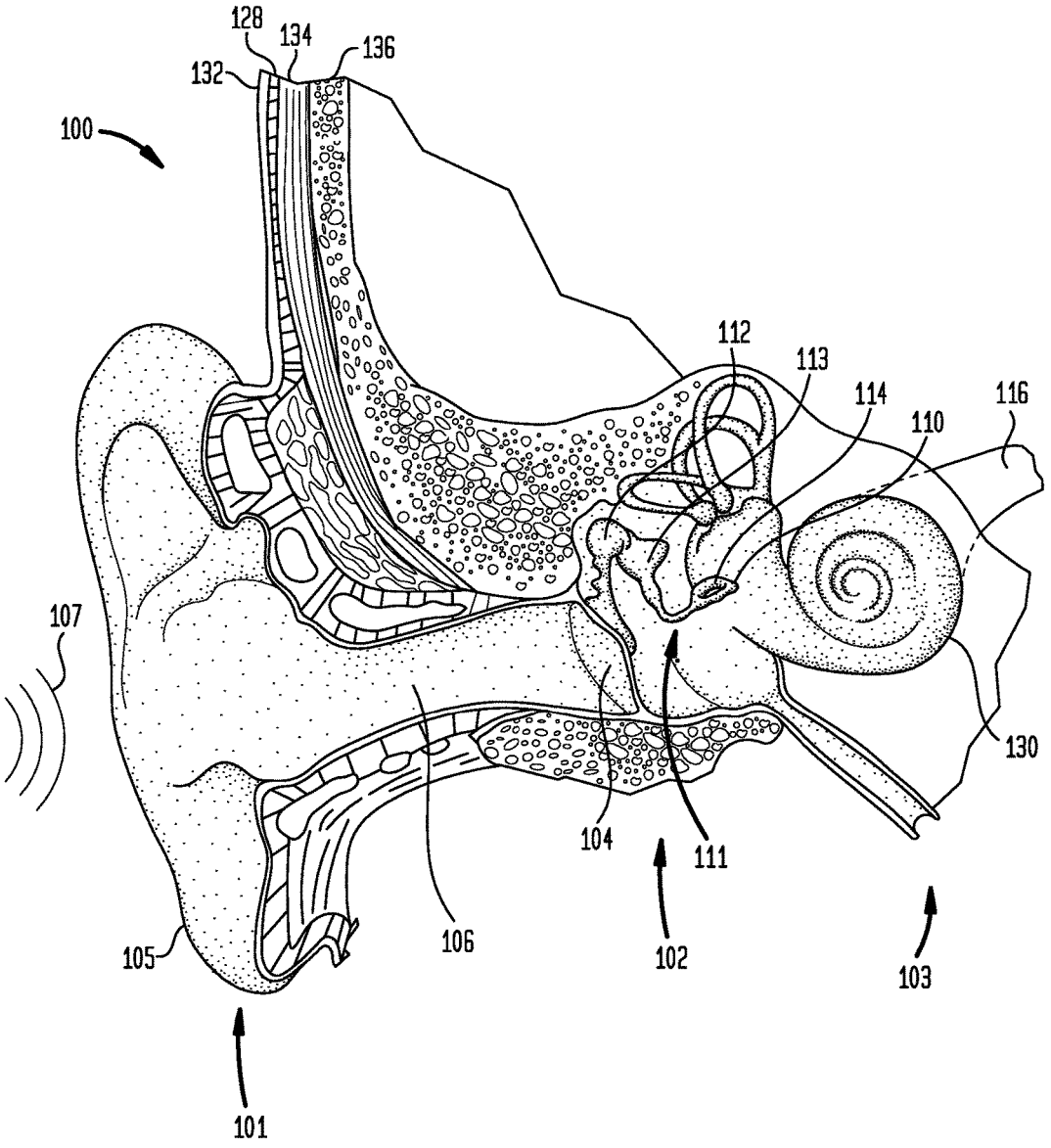
FIG. 1 is a cross-sectional view of a portion of a head of a user.

FIG. 1 is a cross-sectional view of a portion of a head 100 of a user that may utilize a wearable band in accordance with embodiments presented. Shown in FIG. 1 is an outer ear 101, a middle ear 102 and an inner ear 103 of the user. In a fully functional human hearing anatomy, the outer ear 101 comprises an auricle 105 and an ear canal 106. A sound wave or acoustic pressure 107 is collected by the auricle 105 and channeled into and through the ear canal 106. Disposed across the distal end of the ear canal 106 is a tympanic membrane 104 which vibrates in response to the acoustic wave 107. This vibration is coupled to the oval window or fenestra ovalis 210 through three bones of middle ear 102, collectively referred to as the ossicular chain or ossicles 111 and comprising the malleus 112, the incus 113 and the stapes 114. The ossicles 111 of the middle ear 102 serve to filter and amplify the acoustic wave 107, causing oval window 210 to vibrate. Such vibration sets up waves of fluid motion within the cochlea 130 which, in turn, activates hair cells (not shown) that line the inside of the cochlea 130. Activation of these hair cells causes appropriate nerve impulses to be transferred through the spiral ganglion cells and the auditory nerve 116 to the brain (not shown), where they are perceived as sound.

As noted above, conductive hearing loss may be due to damage to the ossicles 111, damage to the ear canal 106, or other impediment to the normal mechanical pathways that provide sound to the hair cells in the cochlea 130. One treatment for conductive hearing loss is the use of a bone conduction device, which converts received sounds into vibrations that are transferred through the skull 136 to the cochlea 130, thereby causing generation of nerve impulses that result in the perception of the received sound.

Traditionally, bone conduction devices have transferred vibrations to the skull 136 through the use of a percutaneous (skin-penetrating) implant that is physically attached to both an external actuator/vibrator and the skull 136. These bone conduction implants connecting the vibrator to the skull generally comprise two components: a bone attachment piece (e.g., bone fixture/fixture) that is attached or implanted directly to the skull, and a skin penetrating piece attached to the bone attachment piece, commonly referred to as an abutment. A bone conduction device and an associated percutaneous implant is sometimes referred to herein as a "percutaneous" bone conduction device system.

More recently, "transcutaneous" bone conduction device systems have been developed and used to treat conductive hearing loss. These transcutaneous bone conduction device systems typically comprise external components as well as implanted components that are separated by the user's skin/tissue 132/128/134. The implanted components typically comprise an implanted anchor system fixed to the skull 136 to which the external components are coupled via a transcutaneous magnetic field. That is, the external components typically include one or more permanent magnets, and the implanted anchor system includes one or more implanted magnetic components that can be magnetically coupled to the permanent magnets in the external component.

In many of these conventional percutaneous, as well as transcutaneous, bone conduction systems, the implantable components are implanted during a surgical procedure. As a result, conventional systems require a significant commitment by the user to continued future use of the bone conduction system. Additionally, surgical implantation may not be possible or desirable for all users. As such, there is a need for non-surgical bone conduction device systems that can be used, for example, on a temporary basis to enable users to trial the use of a bone conduction device for a period of time or that can be used on a long-term basis (e.g., pediatric use). As noted above, presented herein are non-surgical or superficial wearable bands for facilitating hearing. Wearable bands in accordance with embodiments presented herein, sometimes referred to herein as wearable hearing apparatuses, generally comprise a frame that is shaped to be positioned around a head of a user. The wearable bands further comprise at least one drive plate or adapter configured to be disposed around a section of the frame, wherein the adapter is configured to deliver vibration to the head of the user. The vibration is typically generated based on one or more sound signals received by one or more microphones and processed by a sound processor.

In accordance with embodiments of the present invention, a vibration isolation member is disposed between the frame of a wearable band and the adapter. The vibration isolation member is configured to isolate the frame from the vibration at the adapter so as to reduce vibration of the frame that could cause feedback at the microphones.

More specifically, vibration of the frame in response to vibration of the adapter (for example based on one or more sound signals) could create a pressure wave that can be transferred back to the microphones, thus creating undesirable feedback with the sound processing path. Therefore, in order to the reduce, minimize, or eliminate the occurrences of this undesirable feedback, the vibration isolation members in accordance with embodiments of the present invention have mechanical properties so as to limit the transfer of vibration from the adapter to the frame in a manner that reduces, minimizes, or eliminates instances of feedback inducing vibration. For example, the vibration isolation member can be characterized by an elasticity that would allow it to attenuate, absorb, and/or dampen much of the vibrations at the adapter, as opposed to transferring the vibrations to the frame. Stated differently, isolation of the frame from the vibration of the adapter can be understood to refer to a mechanical decoupling between the adapter and the frame that limits the transfer of vibration to the frame to an extent that instances of deleterious feedback are reduced, minimized, or eliminated. As a result, the vibration isolation can improve the user's hearing experience (e.g., enable more amplification and gain of the sound processor).

In some embodiments, the vibration attenuation provided by the vibration isolation member is dependent on the frequency at which the vibration is generated, and/or dependent on the structural modes of the adapter and the frame. In some instances, the vibration isolation member can provide greater than a 10 dB reduction in the transfer of vibration between the adapter and the frame (relative to direct contact between the adapter and the frame). In certain embodiments, the attenuation reduction may be greater at the resonance frequency of the transducer generating the vibration. In some instances, the vibration isolation member can limit the amount of vibration transferred from the adapter to the frame to less than 50% of the total vibration at the adapter (i.e., the vibration isolation member can attenuate, absorb, or dampen greater than 50% of the vibration received from the adapter). In some instances, the vibration isolation member can limit the amount of vibration transferred from the adapter to the frame to less than 40% of the total vibration at the adapter (i.e., the vibration isolation member can attenuate, absorb, or dampen greater than 60% of the vibration received from the adapter). In some instances, the vibration isolation member can limit the amount of vibration transferred from the adapter to the frame to less than 30% of the total vibration at the adapter (i.e., the vibration isolation member can attenuate, absorb, or dampen greater than 70% of the vibration received from the adapter). In some instances, the vibration isolation member can limit the amount of vibration transferred from the adapter to the frame to less than 20% of the total vibration at the adapter (i.e., the vibration isolation member can attenuate, absorb, or dampen greater than 80% of the vibration received from the adapter). In some instances, the vibration isolation member can limit the amount of vibration transferred from the adapter to the frame to less than 10% of the total vibration at the adapter (i.e., the vibration isolation member can attenuate, absorb, or dampen greater than 90% of the vibration received from the adapter). In some instances, the vibration isolation member can attenuate, absorb, or dampen 100% of the vibration received from the adapter.

Vibration isolation members in accordance with embodiments presented herein can have any of a variety of configurations and can be formed from any of a variety of materials, mechanisms, etc. In accordance with certain embodiments presented herein, a vibration isolation member is formed from a flexible material, such as a silicone material, an elastomer material (e.g., a visco-elastic polymeric solid), a rubber material, a foam material, a neoprene material (e.g., neoprene rubber), and/or any other material configured to attenuate/dampen vibration. In some instances, a vibration isolation member comprises a thin membrane, a mechanical spring (e.g., steel spring, spiral-shaped element, etc.) or other type mechanical linkage mechanism that is operable to attenuate/dampen vibration.

Figure 2A:
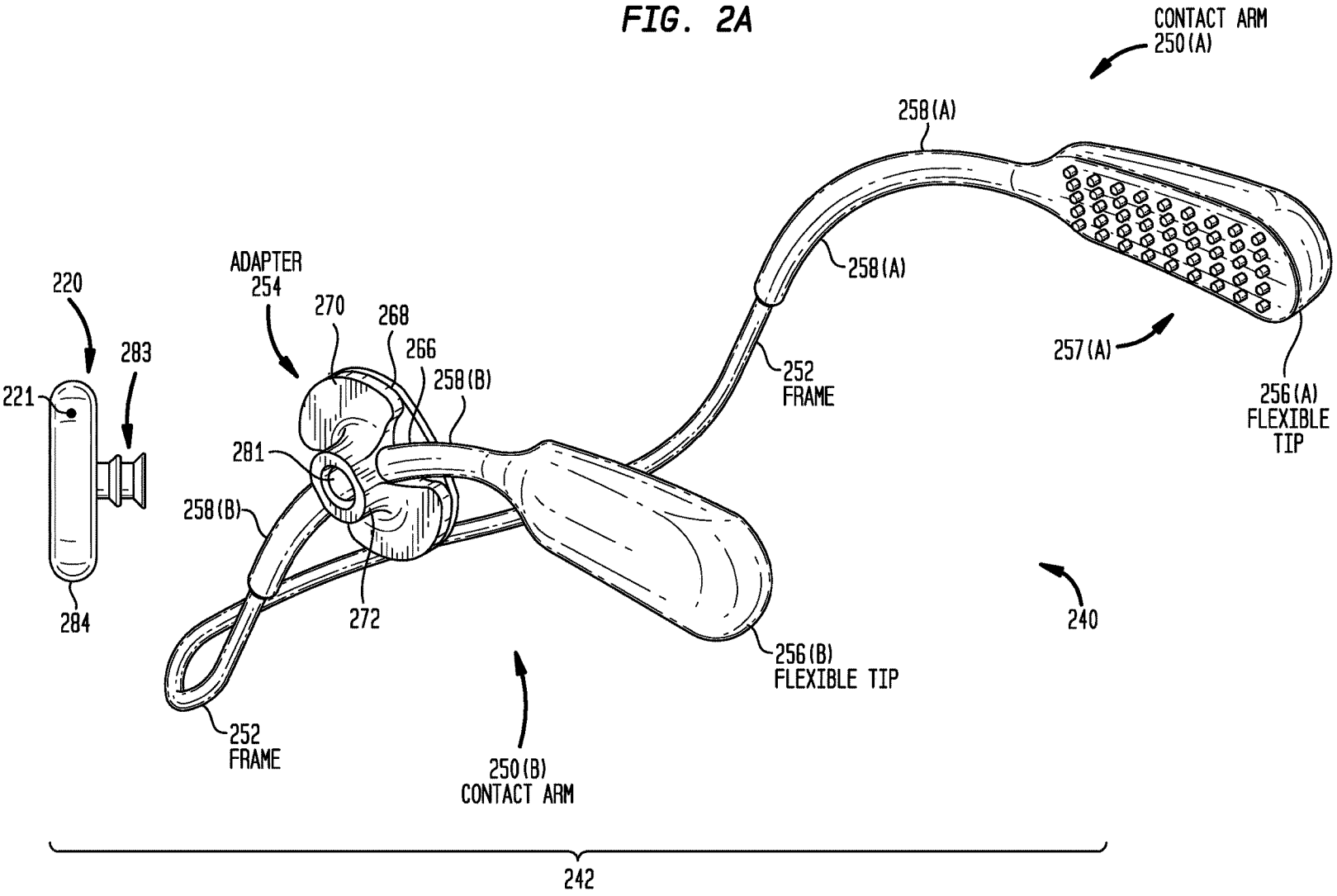
FIG. 2A is a perspective view of a wearable band, in accordance with certain embodiments presented herein.
Figure 2B:
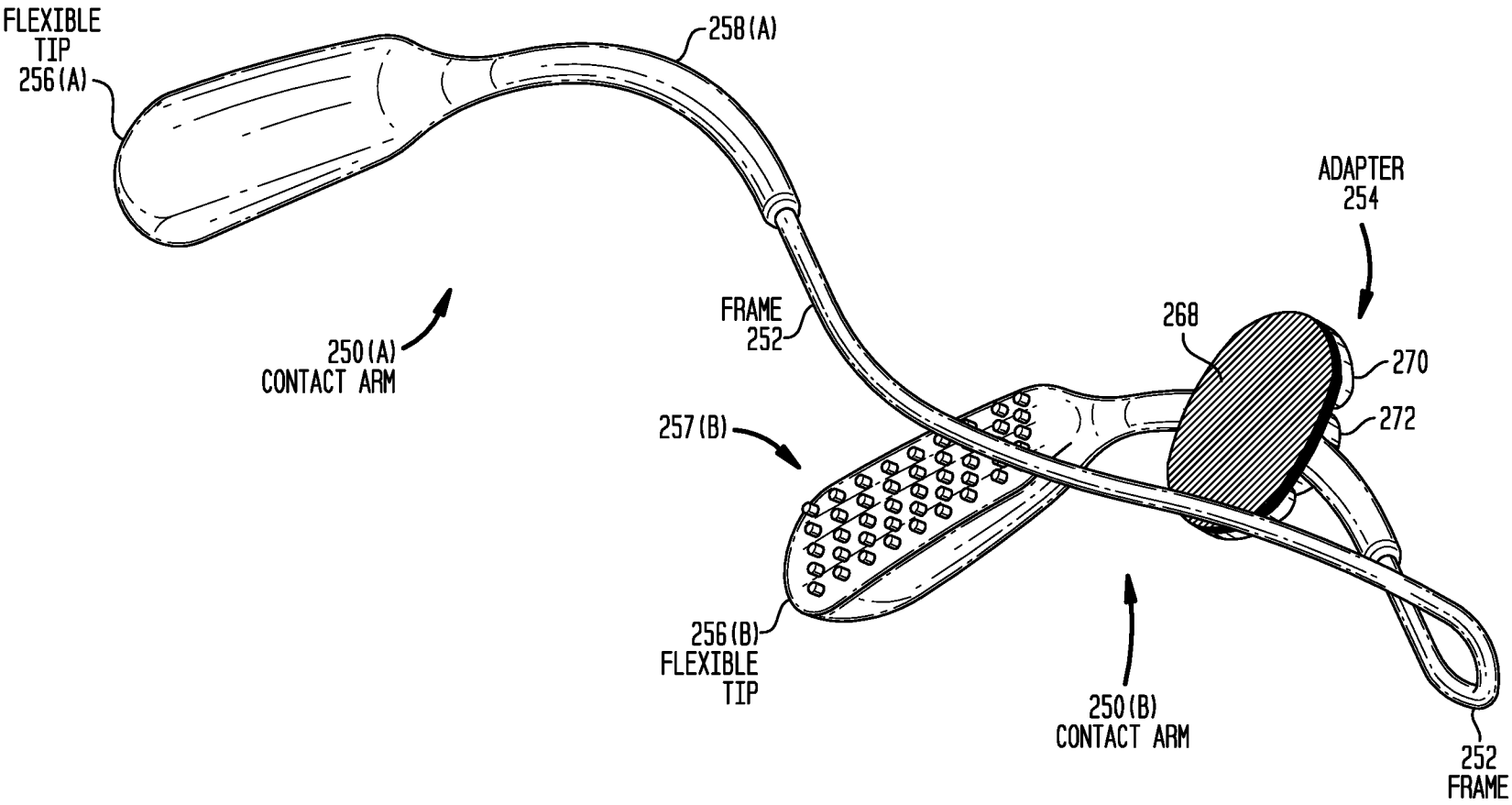
FIG. 2B is another perspective view of a wearable band, in accordance with certain embodiments presented herein.
Figure 2C:
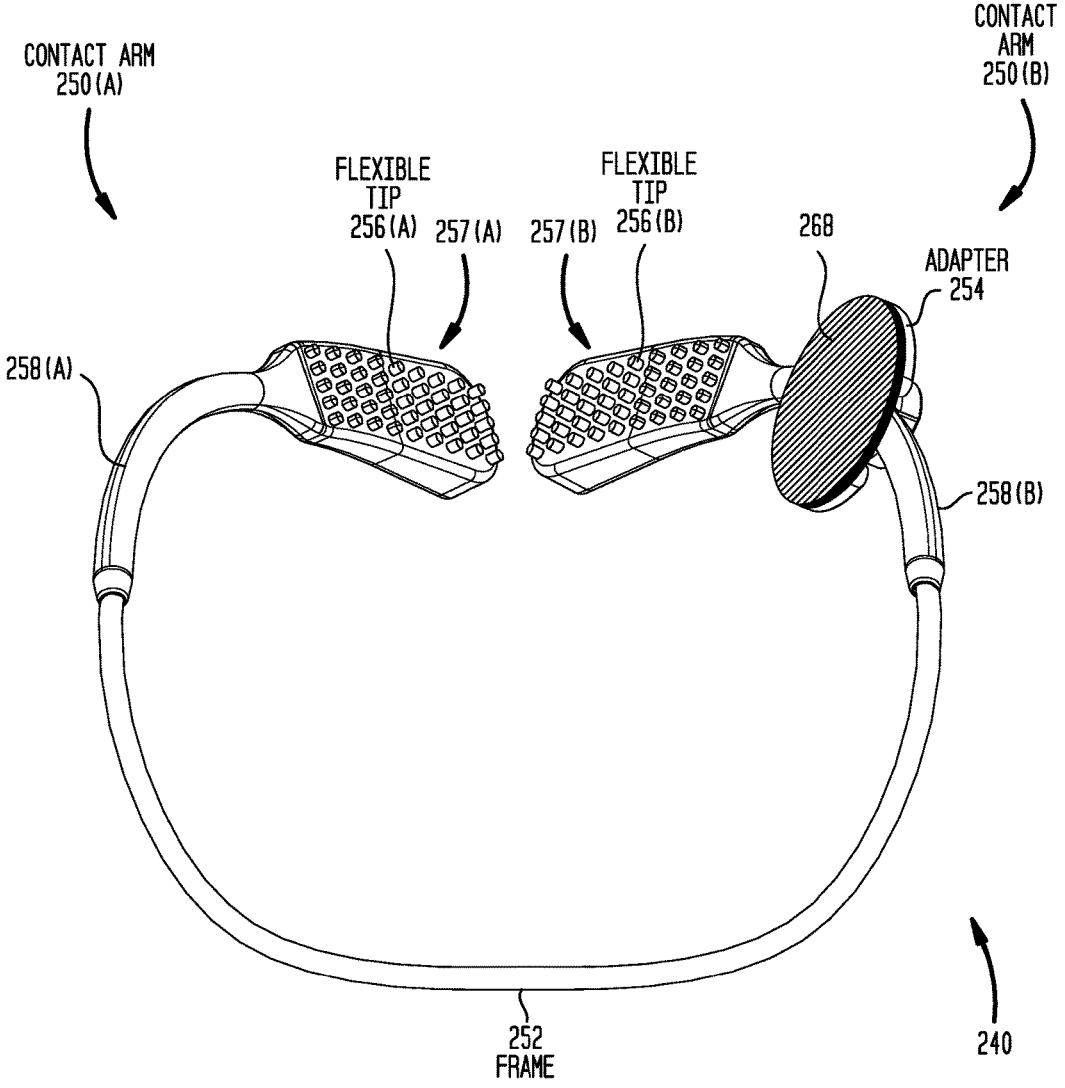
FIG. 2C is a rear view of a wearable band, in accordance with certain embodiments presented herein.
Figure 2D:
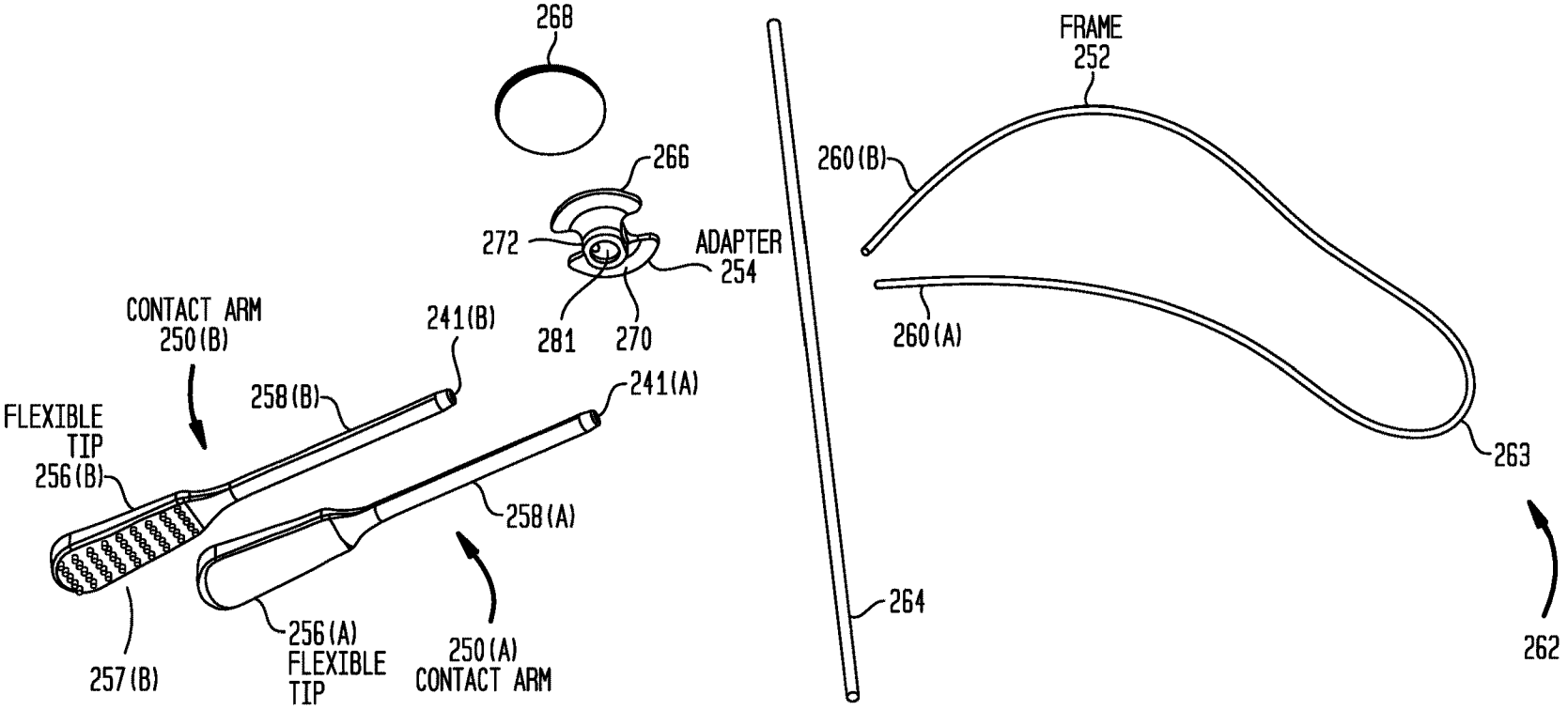
FIG. 2D is an exploded view of a wearable band, in accordance with certain embodiments presented herein.
Figure 2F:
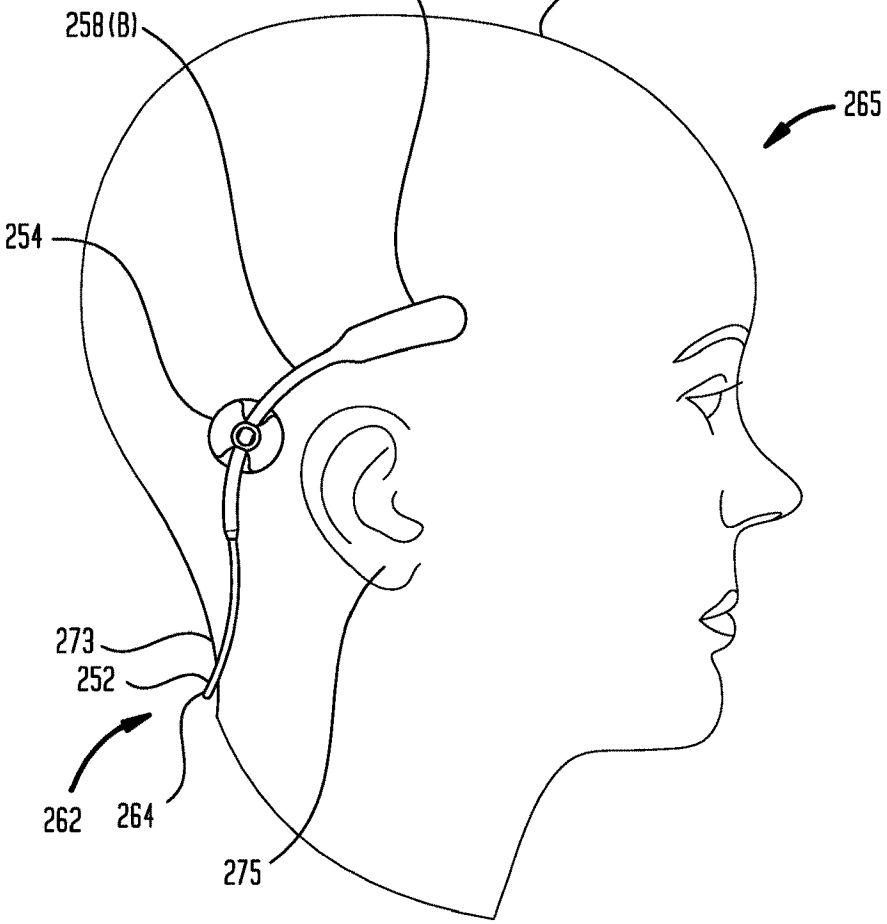
FIG. 2F is a diagram illustrating the positioning of a wearable band on the head of a user, in accordance with certain embodiments presented herein, on the head of a user.
Figure 2E:
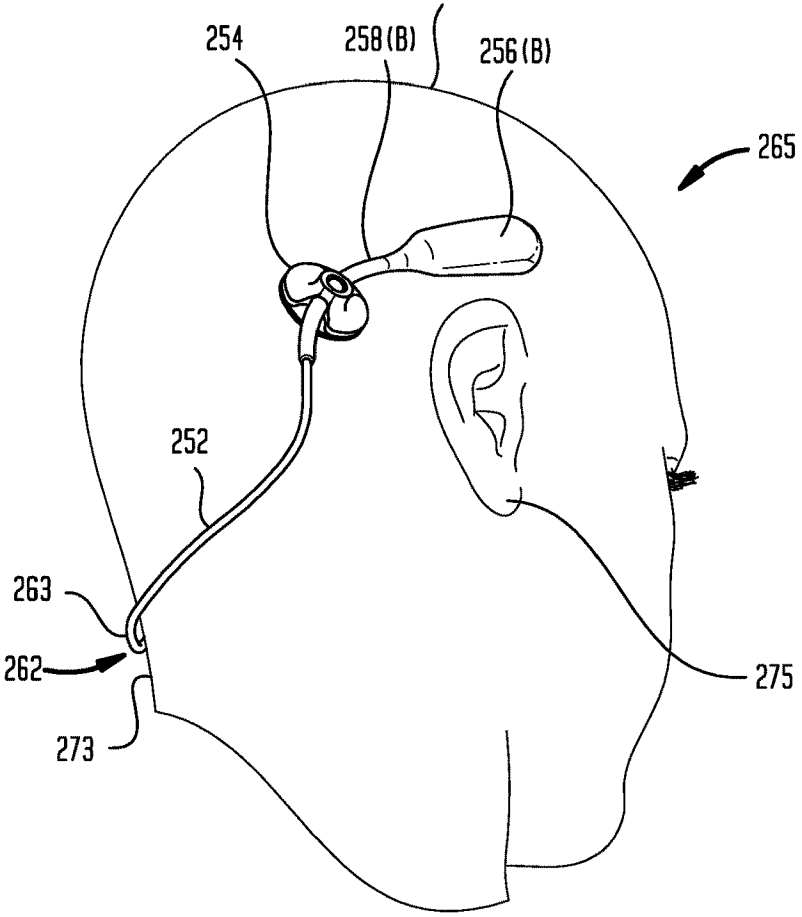
FIG. 2E is a diagram illustrating the positioning of a wearable band on the head of a user, in accordance with certain embodiments presented herein, on the head of a user.

FIGS. 2A and 2B are perspective views of a wearable band 240 in accordance with certain embodiments presented herein. FIG. 2C is a rear view of the wearable band 240 of FIG. 2A, while FIG. 2D is an exploded view of the wearable band 240. FIGS. 2E and 2F are schematic diagrams illustrating the positioning of the wearable band 240 on the head 200 of a user. In FIG. 2A, the wearable band 240 is shown with a bone conduction device 220, while the bone conduction device has, for ease of illustration, been omitted from FIGS. 2B, 2C, 2D, 2E, and 2F. Collectively, wearable band 240 and the bone conduction device 220 form a non-surgical or superficial (transcutaneous) bone conduction device system 242. For ease of description, FIGS. 2A-2F will be described together.

In the illustrative embodiments of FIGS. 2A-2F, the wearable band 240 is comprised of four (4) primary components, namely a first contact portion/arm 250(A), a second contact arm 250(B), a frame 252, and a drive plate or adapter 254. The contact arms 250(A) and 250(B) are each comprised of a respective flexible tip 256(A) and 256(B) and a respective flexible sleeve 258(A) and 258(B). The flexible tips 256(A) and 256(B) each include a respective inner surface 257(A) and 257(B). In general, the flexible sleeves 258(A) and 258(B) are integrated with, and extend from, the respective flexible tip 256(A) and 256(B).

Although FIGS. 2A-2F will generally be described with reference to wearable bands that comprise four primary components, it is to be appreciated that this specific segregation is merely illustrative and that the various parts of wearable bands in accordance with embodiments presented herein may be integrated or further segregated in different combinations. That is, wearable bands in accordance with embodiments presented herein may comprise any number of different elements, groups of elements, etc.

As shown in FIG. 2D, the frame 252 comprises a first end region/section 260(A), a second end region 260(B), and a central region 262 centered around a center point 263. The center point 263 is the geometric center of the frame 252. In certain embodiments, an outer covering/tube 264 (FIG. 2D) may be disposed around a portion of the frame 252. In general, the outer tube 264 is an aesthetic element that may have different colors, patterns, etc. For ease of illustration, the outer tube 264 has been omitted from FIGS. 2A, 2B, 2C, 2E, and 2F.

As shown in FIGS. 2A, 2B, and 2C, the first and second contact arms 250(A) and 250(B) are configured to be disposed around (and extend along) the first and second end regions 260(A) and 260(B), respectively, of the frame 252. That is, the first and second contact arms 250(A) and 250(B) each include a corresponding aperture 241(A) and 241(B) (shown in FIG. 2D) into which the first end region 260(A) or the second end region 260(B) can be inserted. In general, the first and second end regions 260(A) and 260(B) of the frame 252 each extend through the respective flexible sleeve 258(A) and 258(B), and substantially through the respective flexible tips 256(A) and 256(B) (i.e., the frame 252 extends proximate to an end of the flexible tips).

In the illustrated embodiment, the adapter 254 is configured to be disposed around one of the flexible sleeve 258(A) and 258(B) and is configured to detachably connect with (i.e., mechanical mate with) the bone conduction device 220. The adapter 254 has a substantially planar first or inner surface 266 that is configured to be positioned adjacent to, and face towards, the head 200 of the user. In the examples of FIGS. 2A-2F a substantially thin layer of padding, referred to herein as pad 268, is configured to be attached (e.g., adhered) to the inner surface 266 so as to separate the head 200 from the inner surface 266. It is to be appreciated that the use of the pad 268 is illustrative.

The adapter 254 also includes a second or outer surface 270 that is generally disposed opposite to the inner surface 266. Extending from the outer surface 270 is a device connector 272 that is configured to attach to the bone conduction device 220. As described further below, when the bone conduction device 220 is attached to the adapter 254, the adapter is configured to transfer vibration generated by the bone conduction device 220 to the user's head. The bone conduction device 220 comprises one or more microphones 221 that are configured to receive acoustic sound signals and to convert the sound signals into electrical signals. The bone conduction device 220 may, in certain embodiments, also comprise other sound input elements, such as a telecoil, an audio port, etc., that are also configured to receive sound signals. The bone conduction device 220 also comprises a sound processor and an actuator, both of which have been omitted from FIG. 2B for ease of illustration. In operation, the sound processor receives electrical signals from the microphones 221 and/or other sound inputs and converts those electrical signals into control signals. The control signals, when delivered to the actuator, cause the actuator to generate mechanical motion of one or more components and, accordingly, impart vibration to the adapter 254 and the head 200 of the user.

An adapter of a wearable band in accordance with embodiments presented, such as adapter 254, can be detachably connected to a bone conduction device using a number of different types of device connectors. In the specific illustrated example of FIGS. 2A-2F, the device connector 272 is a snap-in connector configured to "snap couple" the bone conduction device 220 to the adapter. In one form, the snap-in connector 272 has a general frustoconical shape.

As shown in FIGS. 2A and 2D, the snap-in connector 272 includes an aperture 281. The aperture 281 has an arrangement (e.g., size, shape, internal features, etc.) so as to receive and mate with a corresponding snap-in coupler 283 (FIG. 2B) of the bone conduction device 220. The snap-coupler 283 is a male member that extends from a main portion 284 of the bone conduction device 220. The aperture 281 of the snap-in connector 272 and a distal end of the snap-coupler 283 have corresponding structural features/arrangements such that, when the distal end is pushed into the aperture 281, the bone conduction device 220 is mechanically attached/connected to the adapter 254. The bone conduction device 220 can be detached from the adapter 254 by removing (e.g., pulling) the snap-coupler 283 from the aperture 281.

It is to be appreciated that the specific snap-in coupling mechanism of FIGS. 2A-2F is illustrative and, as noted above, an adapter in accordance with embodiments presented herein may be coupled to a bone conduction device or other device using any of a variety of different mechanisms. For example, in alternative embodiments an adapter may include one or more magnetic components (e.g., magnets) configured to be magnetically coupled to one or more magnetic components of a bone conduction device (i.e., a magnetic coupling). In other embodiments, an adapter may include a threaded member (male or female) that is configured to mate with a corresponding threaded member of a bone conduction device (i.e., a screw-in coupling). Again, these specific types of coupling mechanisms are illustrative.

The adapter 254 is formed from a rigid material that is configured to efficiently transfer vibration from the bone conduction device 220. For example, in certain embodiments the adapter 254 is formed from a metal, such as aluminum, tungsten, iron, etc., a metal alloy, or other rigid material. In the example of FIGS. 2A-2F, the adapter 254 is shown positioned on flexible sleeve 258(B). However, as described further below, the adapter 254 may also or alternatively be positioned on the flexible sleeve 258(A).

As noted above, and as shown in FIGS. 2E and 2F, the wearable band 240 is configured to be worn on the head 200 of a user. When the wearable band 240 is worn on the head 200 of the user, the frame 252 extends in a rearward direction (i.e., away from the front 265 of the head 200). In the examples of FIGS. 2A-2F, the frame 252 is biased so as to force the inner surfaces 257(A) and 257(B) of the flexible tips 256(A) and 256(B) against opposing sides (i.e., left and right sides, respectively) of the head 200. The frame 252 is also configured (e.g., biased, shaped, etc.) to force the surface 266 of the adapter 254 (via pad 268) against the head 200. In other words, when the wearable band 240 is being worn around the user's head 200, the frame 252 is biased inward so as to press the first and second flexible tips 256(A) and 256(B), as well as the surface 266 of the adapter 254, against the head of the user. In general, the frame 252 is configured such that when the wearable band 240 is being worn around the user's head 200, only the flexible tips 256(A) and 256(B) and the surface 266 of the adapter 254 abut the user's head. That is, remaining portions of the wearable band 240 other than the flexible tip 256(A), flexible tip 256(B), and the surface 266 of the adapter 254 are generally spaced/separated from the head 200 (i.e., the wearable band 240 provides for discrete pressure points on the head where the frame 252 is entirely separated from the head). The pressure applied by the frame 252 to the adapter 254 so as to force the adapter to abut the head 200 ensures efficient transfer of the vibration from the adapter 254 to the head 200.

The frame 252 is formed from a substantially rigid biased or resilient material and is configured (e.g., has material properties) such that it can be pre-bent into an initial general shape (described further below) and is able to retain the pre-bent initial shape in the absence of the application of external forces. However, the frame 252 is also configured (e.g., has material properties) such that the pre-bent general shape can modified or altered by a user (e.g., adjust the shape to best fit the specific head shape of the user). In certain embodiments, the frame 252 is formed from spring steel. However, the frame 252 may also be formed from other types of metals, metal alloys, composite structures, and/or non-metals that enable the frame to operate as described herein.

In the initial general shape, the frame 252 is biased inward and is configured such that the outer diameter thereof may be resiliently expanded to enable the wearable band 240 to be placed on the head 200 of the user. That is, when the wearable band 240 is placed on the head 200, the frame 252 is configured such that the first and second flexible tips 256(A) and 256(B) can be pulled away from each other. Once placed on the head, the inward bias of the frame 252 causes the frame to force the first and second flexible tips 256(A) and 256(B), as well as the inner surface 266 of the adapter 254, inward and against the head 200 of the user.

FIGS. 2A-2D illustrate the wearable band 240, and more specifically the frame 252, in a relaxed state where no exterior forces are applied to the frame 252. However, FIGS. 2E and 2F illustrate the wearable band 240 placed around a portion of the head 200 where the inward bias of the frame 252 forces the first and second flexible tips 256(A) and 256(B), and the inner surface 266 of the adapter 254, inward and against the head 200 of the user (i.e., the frame 252 places a compression force on the head 200 at the flexible tips and the adapter). The first and second flexible tips 256(A) and 256(B) are formed from any of a variety of flexible materials, such as a silicone material, an elastomer material (e.g., a visco-elastic polymeric solid), a rubber material, a foam material, a neoprene material (e.g., neoprene rubber), and/or any other material configured to be slightly compressed between the head 200 and the frame 252 and to attenuate/dampen vibration. The compression of the first and second flexible tips 256(A) and 256(B) may enhance retention of the wearable band 240 on the head 200, as well as make the interface more comfortable to the user. In general, the frame 252 is configured such that the inward bias of the frame 252 will place a compression force on the head 200 so as to retain the wearable band 240 on the head 200 without the need for supplemental support provided by, for example, the user's outer ear.

As shown in FIGS. 2E and 2F, the wearable band 240 is configured such that, when worn by a user, the flexible tips 256(A) and 256(B) are positioned proximate to the user's temple regions (temples) (i.e., in front of, and above, the user's ears 275, where 'front' and 'behind' are with reference to the vertical direction when the user is looking directly forward). The frame 252 generally has a downward curve such that, from the flexible tips 256(A) and 256(B), the frame extends downward behind the ears 275 to the central point 262. As such, when the wearable band 240 is worn by the user, at least a portion of the frame 252 (e.g., the central region 262 extending between the first and second end regions 260(A) and 260(B)) forms a concave upward curve. As a result, the central point 263 is positioned behind the neck 273 of the user. In this arrangement, the adapter 254 is placed adjacent the user's mastoid. In addition, the adapter 254 is positioned at a selected mounting position that is proximate to the mastoid bone of the user.

Although FIGS. 2A-2E illustrate one example configuration for implementing a wearable band for facilitating hearing in accordance with embodiments of the present invention, it is to be appreciated that any of a variety of configurations can be implemented that allow for vibrationally isolating an actuating component from a respective frame in accordance with embodiments of the invention. For example, although FIGS. 2A-2F have generally been described with reference to wearable bands that comprise four primary components, it is to be appreciated that this segregation of elements is merely illustrative and that the various parts of wearable bands in accordance with embodiments presented herein may be integrated or further segregated in different combinations. That is, wearable bands in accordance with embodiments presented herein may comprise any number of different elements, groups of elements, etc. In certain embodiments the contact portions are integral with the frame, and a separate vibrationally isolating sleeve may be incorporated. Alternatively, in some embodiments, the flexible tips are integral with the frame, but are sufficiently pliable that they can act as the vibrationally isolating sleeve.

In addition, although a certain frame shape is illustrated in FIGS. 2A-2F, it is to be appreciated that any of a variety of frames can be implemented. For example, frames having more attachment configuration options, multiple parts, different shapes, etc. are all within the scope of the embodiments of the present invention.

Furthermore, it is to be appreciated that the adapter configurations shown in FIGS. 2A-2F are illustrative and that any suitable adapter configuration can be implemented that allows for the delivery of vibration to the head of a user while, as described further below, enabling the frame to be isolated from the vibration at the adapter. It is also to be appreciated that the location of the adapter in FIGS. 2A-2F is illustrative and that adapters in accordance with embodiments presented herein can be positioned in any suitable location (e.g. locations other than proximate the mastoid bone) consistent with bone conduction theory.

FIGS. 2A-2F have generally been described with reference to a single adapter 254 disposed on the flexible sleeve 258(B) that is able to couple a single bone conduction device 220 to the head 200 of a user. It is to be appreciated that these embodiments are illustrative and that wearable bands in accordance embodiments presented herein may have different arrangements. For example, in one alternative arrangement the single adapter 254 may be disposed on the flexible sleeve 258(A). In certain such embodiments, upon application of a user-applied force, the adapter 254 may be configured to be disengaged from a selected mounting position on a first flexible sleeve (e.g., either the flexible sleeve 258(A) or the flexible sleeve 258(B)) and to be slid along the first flexible sleeve and around the frame 252 to the second flexible sleeve. In response to continued user-applied force, the adapter 254 may be then slid along the second flexible sleeve to a selected mounting position on the second flexible sleeve. As noted above, the selected mounting positions on the flexible sleeve 258(B) or the flexible sleeve 258(A) may, in certain embodiments, be set by one or more features of the respective flexible sleeve, the outer dimension of the flexible sleeve, etc.

Figure 3:
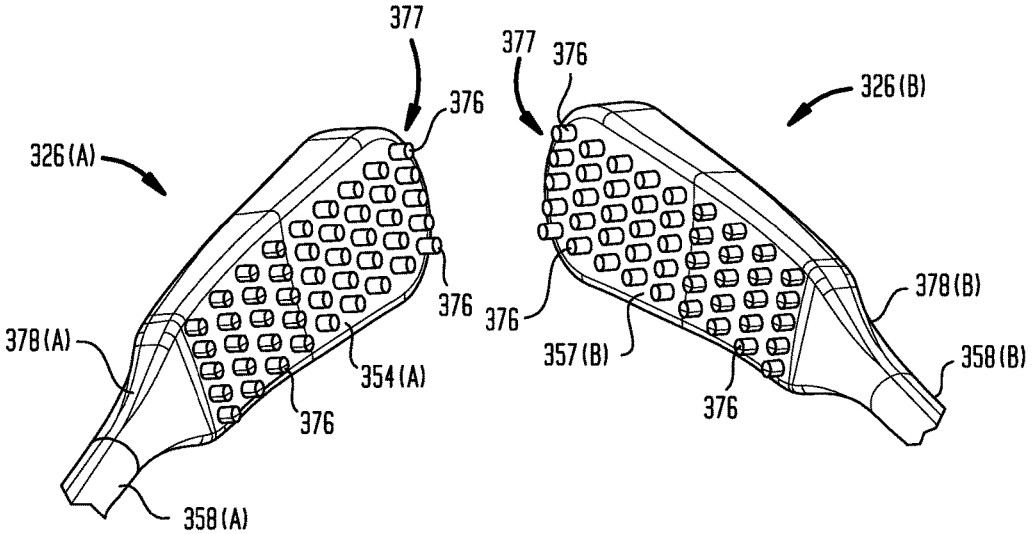
FIG. 3 is a diagram illustrating flexible tips forming part of a wearable band, in accordance with certain embodiments presented herein.

FIG. 3 is a diagram illustrating details of flexible tips of a wearable band in accordance with embodiments of the present invention. More specifically, FIG. 3 illustrates two flexible tips 326(A) and 326(B) that may be disposed at opposing ends of a frame (not shown in FIG. 3) of a wearable band in accordance with embodiments of the present invention. In the illustrative example of FIG. 3, the flexible tips 326(A) and 326(B) are each integrated with a respective flexible sleeve 358(A) and 358(B), which collectively form respective contact arms 350(A) and 350(B). It is be appreciated that the integration of the flexible sleeves and the flexible tips are illustrative and that other embodiments of the present invention may make use of tips and sleeves that are separated.

In the embodiment of FIG. 3, the contact arms 350(A) and 350(B) (i.e., the first and second flexible tips 356(A) and 356(B), as well as the flexible sleeves 358(A) and 358(B)) are formed from a flexible material, such as silicone, rubber, etc. The use of a flexible material for the flexible tips 326(A) and 326(B) may facilitate distribution of the pressure applied by the frame 352.

Also as noted above, the first and second flexible tips 356(A) and 356(B) each include a respective inner surface 357(A) and 357(B). In certain embodiments, these inner surfaces 357(A) and 357(B) are textured to increase friction between the head and the flexible tips 356(A) and 356(B) and, accordingly, enhance retention of the wearable band, and attached bone conduction device, on the head (e.g., a rough geometry against skin/hair to increase the grip around the head). The increased friction provided by the textured inner surfaces 357(A) and 357(B) may provide a reaction against, for example, downward movements of the wearable band and the attached bone conduction device. FIG. 3 illustrates an embodiment in which the inner surfaces 357(A) and 357(B) include a plurality of protrusions/projections 376 each having a general cylindrical/tubular shape. However, it is to be appreciated that the inner surfaces 357(A) and 357(B) may have different textures that are configured to increase friction between the head and the flexible tips 356(A) and 356(B).

In the illustrative embodiment of FIG. 3, an outer dimension (e.g., width) of the flexible tips 326(A) and 326(B) decreases from a maximum at a front end 377 of the tips, to a minimum at the flexible sleeves 358(A) and 358(B), respectively. The flexible tips 326(A) and 326(B) also each include a respectively tapered collar section 378(A) and 378(B) connected to the respective flexible sleeves 358(A) and 358(B).

Although FIG. 3 illustrates a certain texturing for a flexible tip, it is to be appreciated that any suitable texturing can be implemented in accordance with embodiments presented herein. In addition, it is to be appreciated that, in certain embodiments, no texturing is required and the surface of the flexible tips inherently has sufficient frictional qualities to, for example, provide a reaction against, for example, downward movements of the wearable band and the attached bone conduction device.

Figure 4A:
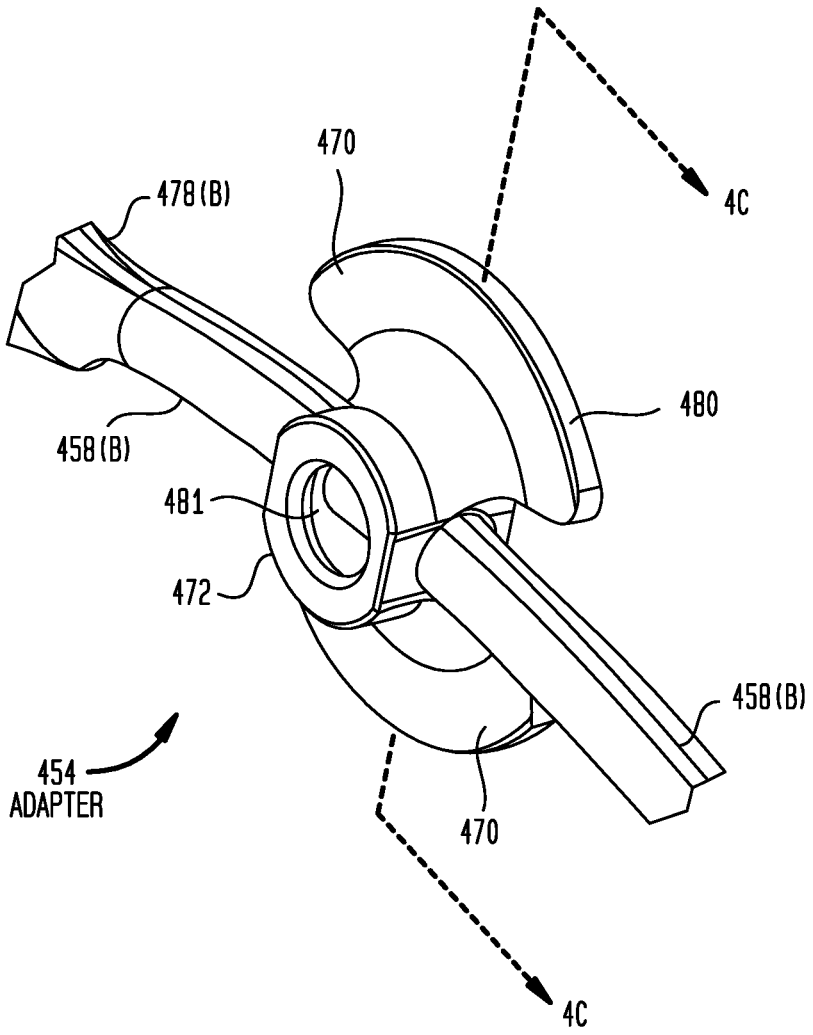
FIG. 4A is a perspective view of an adapter forming part of a wearable band, in accordance with certain embodiments presented herein.
Figure 4B:
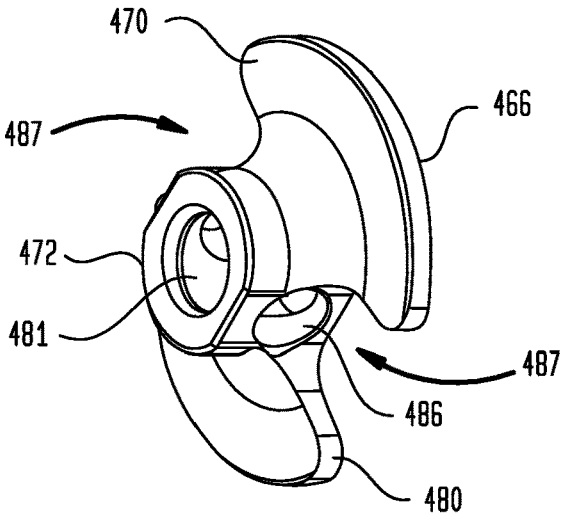
FIG. 4B is another perspective view of an adapter forming part of a wearable band, in accordance with certain embodiments presented herein.
Figure 4C:
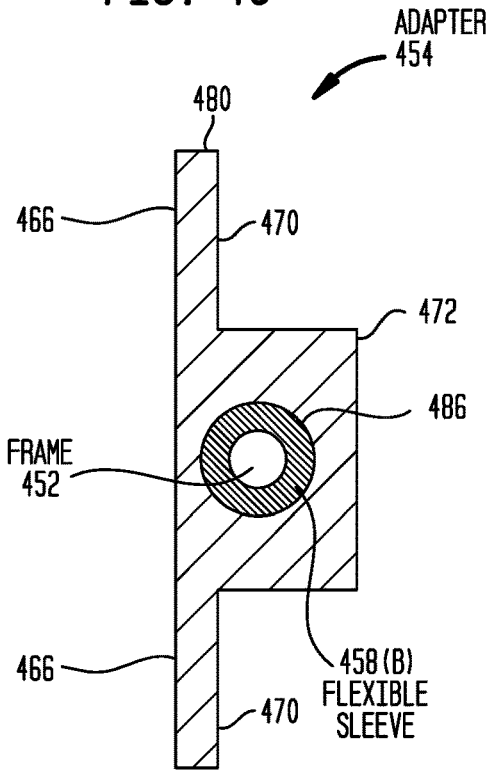
FIG. 4C is a schematic cross-sectional view of an adapter forming part of a wearable band, in accordance with certain embodiments presented herein.

FIGS. 4A, 4B, and 4C are diagrams illustrating an adapter 454, as well as an interface between the adapter 454 and a flexible sleeve 458(B) of a wearable band in accordance with embodiments presented herein. More specifically, FIGS. 4A and 4B are perspective views of the adapter 454, where FIG. 4A illustrates the adapter 454 positioned on the flexible sleeve 458(B) and FIG. 4B illustrates the adapter 454 separate from the flexible sleeve 458(B). FIG. 4C is a cross-sectional view of the adapter 454 taken along line 4C-4C of FIG. 4A. Although FIGS. 4A, 4B, and 4C illustrate the adapter 454 positioned on flexible sleeve 458(B), it is to be appreciated that the adapter 454 may also or alternatively be positioned on the flexible sleeve 458(A).

The adapter 454 comprises a base member 480 that includes the opposing surfaces 466 and 470. Extending from the surface 470 is a device connector 472 that, also as described above, is configured to be rigidly and detachably coupled to a conduction device (e.g., bone conduction device 220 of FIG. 2A) so that the adapter 454 is able to transfer vibration generated by the bone conduction device to the head of a user.

As shown, the adapter 454 is mechanically attached/coupled to the flexible sleeve 458(B). More specifically, the adapter 454 includes an aperture (through-hole) 486 that is configured to receive the flexible sleeve 458(B) therein. In other words, the aperture 486 is configured to be positioned around a portion of the flexible sleeve 458(B) that has the frame 452 disposed therein. In operation, the aperture 486 extends through a central region of adapter and is sized so as to compress the portion the flexible sleeve 458(B) between the adapter 454 and the frame 452 so as to retain the adapter 454 in a selected position on the flexible sleeve 458(B) and the frame 452. That is, the aperture 486 creates an interference fit between the adapter 454 and the flexible sleeve 458(B) so that the adapter is mechanically coupled to the flexible sleeve and, accordingly, the frame 452 disposed within the flexible sleeve.

In addition to coupling the adapter 454 to the flexible sleeve 458(B) and the frame 452, the interference fit between the aperture 486 and the flexible sleeve 458(B) also functions to vibrationally isolate the frame 452 from vibration at the adapter 454 (e.g., vibration delivered to the adapter by the bone conduction device). More specifically, the flexible sleeve 458(B) operates as a suspension interface between the frame 452 and the adapter 454 that mechanically decouples the frame 452 from the vibration delivered to the adapter and, as such, reduces vibration transfer from the adapter to the frame (e.g., the flexible sleeve 458(B) dampens the vibration delivered to the adapter 454).

Isolation of the frame 452 from vibration delivered to the adapter 454 is important as it reduces feedback at the bone conduction device 420. If the frame 452 would vibrate in response to vibration delivered to the adapter 454, the vibration of the frame 452 would become air borne and would be transferred back to the microphones of the bone conduction device, thus creating feedback. As such, the positioning of the flexible sleeve 458(B) between the adapter 454 and the frame enables the frame 452 to remain substantially motionless, even as the adapter 454 moves (vibrates). Stated differently, since the frame 452 is suspended within the flexible sleeve 458(B), the adapter 455 vibrates around the frame 452 and the vibrations are damped through the flexible suspension. The mechanical decoupling between the adapter 454 and frame 452 is such that flexible sleeve 458(B) limits the transfer of vibration to the frame 454 and, according, reduces the generation of airborne vibration by the frame 452.

In the illustrative example of FIGS. 4A-4C, the adapter 454 includes two cut-out portions (cut-outs) 487 that enable a bulk of the adapter 454 to be positioned closer to the head of a user. In particular, as shown in FIG. 4A, the flexible sleeve 458(B) and frame 452 are positioned in the cut-outs 487 on either side of the aperture 486 (i.e., the flexible sleeve 458(B) and frame 452 enter/exit the aperture 486 via the cut-outs 487), thereby enabling the base member 480 and flexible sleeve 458(B) to be positioned closer to the head. Positioning a bulk of the adapter 454 closer to the head, in turn, enables an attached bone conduction device to have a substantially low profile.

As noted above, the adapter 454 is configured to be located at a selected mounting position on a flexible sleeve 458(A) or 458(B) of the wearable band. The selected mounting position locates the adapter 454 such that, when the wearable band is worn by the user, the adapter 454 will be positioned adjacent to the user's mastoid bone. This location adjacent to the user's mastoid bone makes the bone conduction device more discrete and enables efficient transfer of vibration to the inner ear. In certain embodiments, the selected mounting position is configurable via the interference fit between the aperture 486 and a flexible sleeve 458(A) or 458(B). For example, the flexible sleeves 458(A) and 458(B) may have a substantially consistent outer dimension (e.g., diameter) extending along an elongate length thereof. The outer dimension of the flexible sleeves 458(A) and 458(B), and the outer dimension (e.g., diameter) of the aperture 486 are selected such that an interference fit can be created anywhere along the length of the sleeve having the substantially consistent outer dimension. As a result, the adapter 454 may be located at different selected mounting positions along a length of the flexible sleeves 458(A) and 458(B).

Alternatively, the selected mounting position for the adapter 454 on the flexible sleeve 458(B) or the flexible sleeve 458(A) may be set by one or more features of the respective flexible sleeve. For example, in certain embodiments, the one or more features that set the selected mounting positions may comprise one or more thickness changes in the flexible sleeves 458(A) and 458(B). These thickness changes may be abrupt thickness changes (e.g., steps or ledges molded into the flexible sleeve) or gradual changes (e.g., a tapered shape).

Furthermore, it is to be appreciated that the adapter configurations shown in FIGS. 4A-4C are illustrative and that any suitable adapter configuration can be implemented that allows for the delivery of vibration to the head of a user while, as described above, enabling the frame to be isolated from the vibration at the adapter. That is, although one adapter configuration has been illustrated and discussed, any of a variety of adapter configurations that allow for vibrational isolation as between an actuator and a corresponding frame can be incorporated in accordance with embodiments of the invention.

Figure 5:
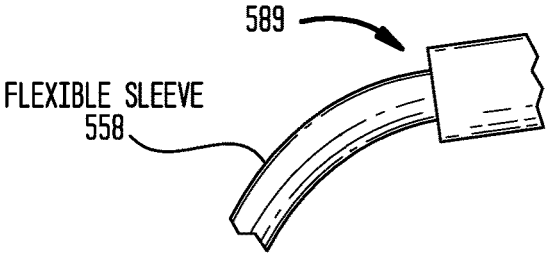
FIG. 5 is a schematic diagram illustrating a portion of a flexible sleeve forming part of a wearable band, in accordance with certain embodiments presented herein.
Figure 6:
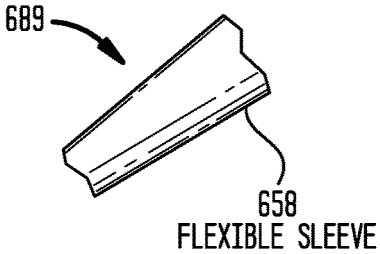
FIG. 6 is a schematic diagram illustrating a portion of a flexible sleeve forming part of a wearable band, in accordance with certain embodiments presented herein.
Figure 7:
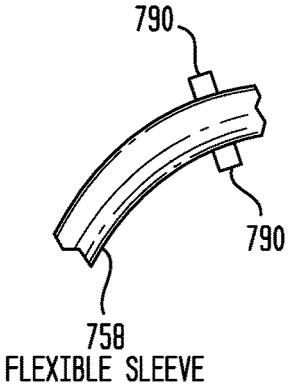
FIG. 7 is a schematic diagram illustrating a portion of a flexible sleeve forming part of a wearable band, in accordance with certain embodiments presented herein.

FIG. 5 illustrates an example flexible sleeve 558 in accordance with embodiments presented herein that includes a discrete thickness change 589 to set a selected mounting position of an adapter (not shown in FIG. 5). FIG. 6 illustrates an example flexible sleeve 658 in accordance with embodiments presented herein that includes a gradual thickness change 689 to set a selected mounting position of an adapter (not shown in FIG. 6). In other embodiments, the one or more features that set the selected mounting positions may comprise one or more stop members, such as tabs, protrusions, rings, etc. that extend outward from the surface of the flexible sleeve. FIG. 7 illustrates an example flexible sleeve 758 in accordance with embodiments presented herein that includes stop members 790 to set a selected mounting position of an adapter (not shown in FIG. 7). As noted above, it may be desirable to locate an adapter at different selected mounting positions. As such, flexible sleeves in accordance with embodiments presented herein may include multiple sets of stop members, thickness changes, etc., to facilitate adjustments in the selected mounting position for the adapter.

Figure 8A:
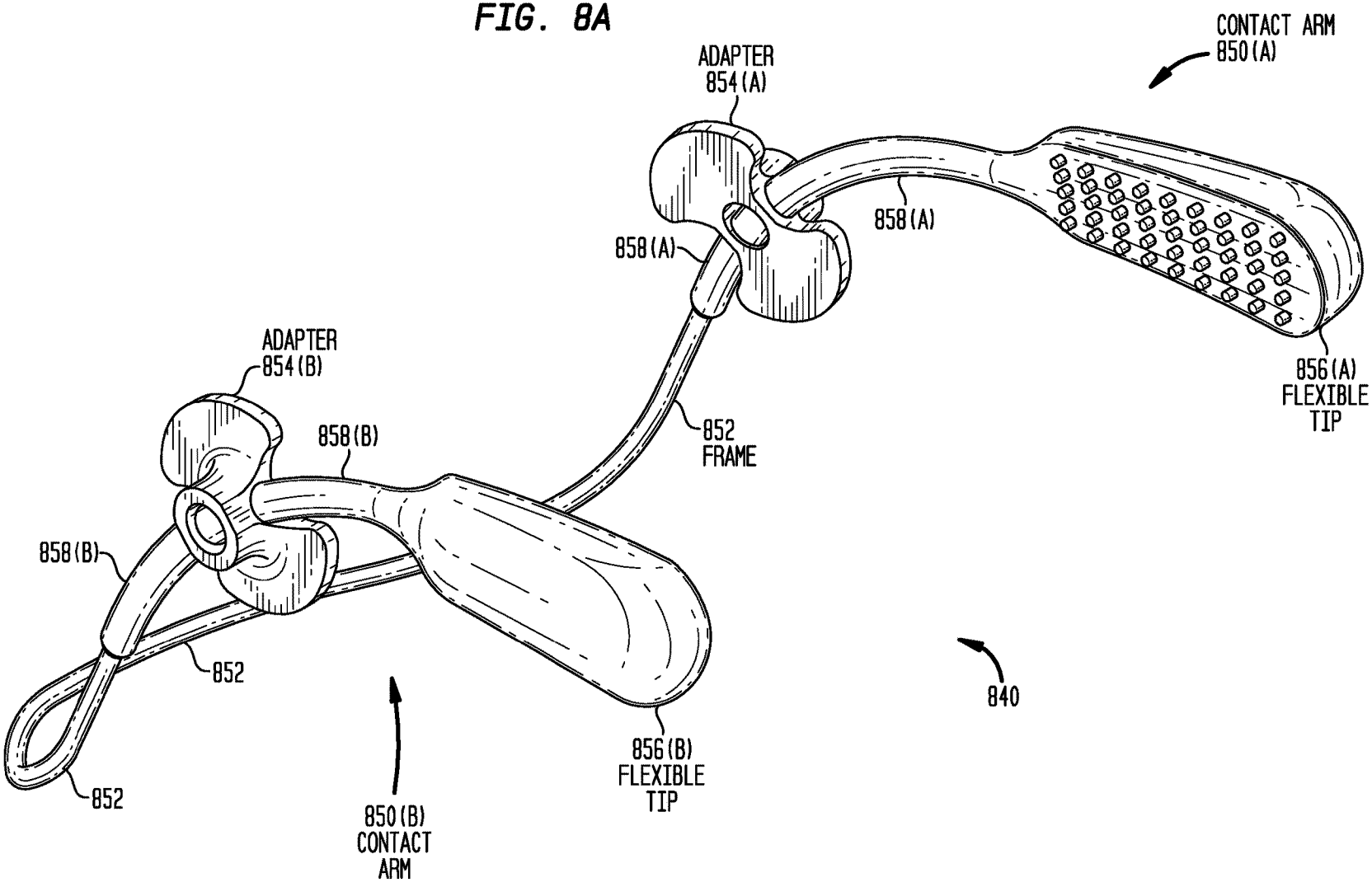
FIG. 8A is a perspective view of a wearable band that includes two adapters, in accordance with certain embodiments presented herein.
Figure 8B:
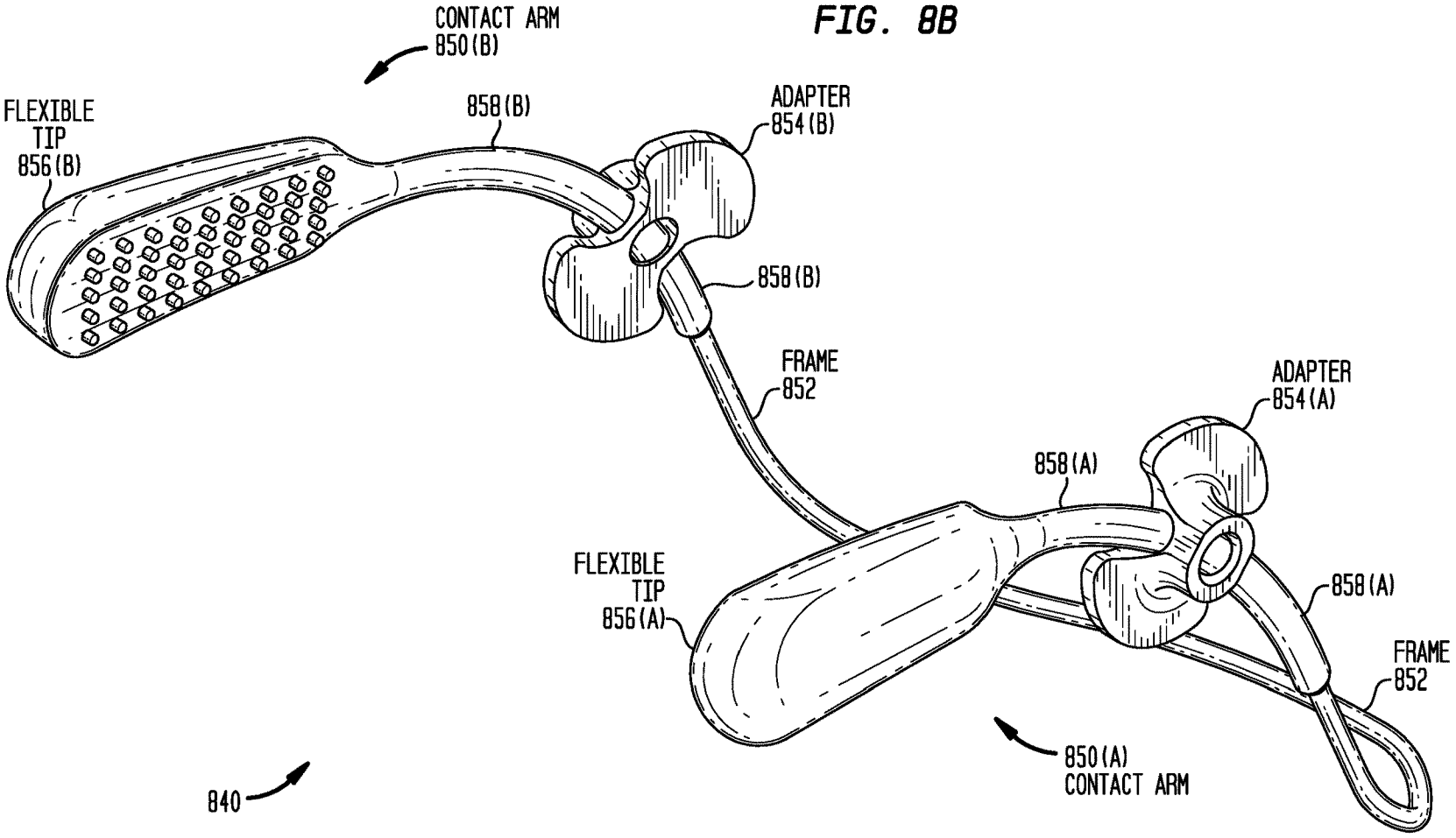
FIG. 8B is another perspective view of a wearable band that includes two adapters, in accordance with certain embodiments presented herein.

As noted, the above embodiments have generally been described with reference to a single adapter that is able to couple a single bone conduction device to the head of a user. It is to be appreciated that these embodiments are illustrative and that wearable bands in accordance embodiments presented herein may have different arrangements. For example, in certain embodiments presented herein, a wearable band may include two adapters located on opposing flexible sleeves. For example, FIGS. 8A and 8B are first and second perspective views of a wearable band 840 that includes two adapters, referred to herein as adapters 854(A) and 854(B) that are each configured to couple to a bone conduction device or other device, as described elsewhere herein. In general, the adapters 854(A) and 854(B) are both substantially similar to adapters described above. In addition, the wearable band 840 is generally similar to wearable band 240, described above, and includes a first contact arm 850(A), a second contact arm 850(B), and a frame 852. The contact arms 850(A) and 850(B) are each comprised of a respective flexible tip 856(A) and 856(B) and a respective flexible sleeve 858(A) and 858(B) to which the adapters 854(A) and 854(B), respectively, are mechanically coupled.

In general, there are competing objectives for the coupling of a bone conduction device to a user. These competing objections include (i) isolating the frame from vibration, (ii) allowing the adapter to be repositioned, and (iii) stabilizing the adapter against the skull. The wearable bands presented herein generally satisfy each of these competing objectives. In particular, the flexible sleeves isolate the frame from vibration at the adapter. In addition, the interference fit between the flexible sleeves and the adapter enable the position of the adapter to be adjusted (e.g., between the right/left side of the head as well as the relative position on the temporal bone). Finally, the adapter is stabilized by the frame and flexible sleeve that passes through a central portion of the adapter.

It is to be understood that terms such as "left," "right," "top," "bottom," "front," "rear," "side," "height," "length," "width," "upper," "lower," "interior," "exterior," "inner," "outer," "forward," "rearward," "upwards," "downwards," and the like as may be used herein, merely describe points or portions of reference and do not limit the present invention to any particular orientation or configuration. Further, terms such as "first," "second," "third," etc., merely identify one of a number of portions, components and/or points of reference as disclosed herein, and do not limit the present invention to any particular configuration or orientation.

It is to be appreciated that the embodiments presented herein are not mutually exclusive.

The invention described and claimed herein is not to be limited in scope by the specific preferred embodiments herein disclosed, since these embodiments are intended as illustrations, and not limitations, of several aspects of the invention. Any equivalent embodiments are intended to be within the scope of this invention. Indeed, various modifications of the invention in addition to those shown and described herein will become apparent to those skilled in the art from the foregoing description. Such modifications are also intended to fall within the scope of the appended claims.

What is claimed is:

1. A wearable band for facilitating hearing, comprising:

a frame curved to extend partially around an outer surface of a head of a user;

first and second flexible contact arms disposed at first and second opposing ends, respectively, of the frame and each extending around a length of the frame, wherein the first and second flexible contact arms each comprise a flexible tip and a flexible sleeve through which the frame extends; and at least one adapter configured to mechanically attach to the flexible sleeve of at least one of the first or second contact arms and configured to deliver vibration to the head of the user, wherein the adapter is vibrationally isolated from the frame by the at least one of the first or second flexible contact arms.

2. The wearable band of claim 1, wherein the at least one adapter comprises an aperture extending through a central region thereof, and wherein the aperture is configured to be positioned around a first portion of the flexible sleeve of the at least one of the first or second between the adapter and the frame.

3. The wearable band of claim 2, wherein the first portion of the flexible sleeve is configured dampen the vibration at the adapter.

4. The wearable band of claim 1, wherein the first and second flexible tips each include an interior surface configured to be compressed against the head of the user, and wherein the interior surfaces of the flexible tips each comprise a plurality of surface features configured to increase frictional forces between the flexible tips and the head of the user.

5. The wearable band of claim 4, wherein the surface features comprise a plurality of cylindrical protrusions.

6. The wearable band of claim 1, wherein the at least one adapter comprises a first surface configured to be positioned adjacent to the head of the user, a second surface substantially opposing the first surface, and a device connector extending from the second surface, wherein the device connector is configured to mate with a vibration device to deliver the vibration to the adapter.

7. The wearable band of claim 1, wherein the at least one adapter comprises first and second adapters positioned on the first and second flexible contact arms, respectively.

8. The wearable band of claim 1, wherein the at least one of the first or second flexible contact arms is formed from a silicone material.

9. The wearable band of claim 1, wherein the frame is biased inward and shaped such that when the wearable band is being worn around the user's head, the frame is configured to compress portions of the first and second flexible contact arms and the at least one adapter against the head of the user.

10. A wearable band for facilitating hearing, comprising:

a frame shaped to be positioned around a head of a user;

a first flexible tip and a first flexible sleeve disposed around a first end of the frame;

a second flexible tip and a second flexible sleeve disposed around a second end of the frame;

at least one drive plate configured to be disposed around a section of the frame and to deliver vibration to the head of the user; and a vibration isolation member comprising a portion of the first flexible sleeve disposed between the frame and the drive plate, wherein the vibration isolation member is configured to isolate the frame from the vibration at the drive plate.

11. The wearable band of claim 10, wherein the vibration isolation member is configured to be compressed between the at least one drive plate and the frame and is configured to dampen received vibrations.

12. The wearable band of claim 10, wherein the at least one drive plate comprises an aperture extending through a central region thereof, and wherein the aperture is configured to be positioned around the first portion of the first flexible sleeve and to compress the first portion between the drive plate and the frame and create an interference fit between the aperture and the first portion.

13. The wearable band of claim 10, wherein the first and second flexible tips each include an interior surface configured to be compressed against the head of the user, and wherein the interior surfaces of the first and second flexible tips each comprise a plurality of surface features configured to increase frictional forces between the first and second flexible tips and the head of the user.

14. The wearable band of claim 10, wherein the frame is substantially resilient and configured to force the at least one drive plate and the first and second flexible tips against the head of the user.

15. The wearable band of claim 10, wherein the at least one drive plate is configured to be coupled with a vibration device that delivers the vibration to the at least one drive plate.

16. The wearable band of claim 10, wherein the at least one drive plate comprises first and second drive plates.

17. The wearable band of claim 10, wherein the vibration isolation member is formed from a silicone material.

18. The wearable band of claim 1, wherein the flexible sleeve of at least one of the first or second contact arms to which the adapter is configured to be mechanically attached is configured to be compressed between the at least one adapter and the frame and to dampen received vibrations.

19. A system comprising the wearable band of claim 1 and at least one bone conduction device configured to be attached to the at least one adapter.

20. A system comprising the wearable band of claim 10 and at least one bone conduction device configured to be attached to the at least one drive plate.

* * * * *